US006138089A

United States Patent [19]

Guberman

[11] Patent Number: 6,138,089

[45] Date of Patent: Oct. 24, 2000

[54] APPARATUS SYSTEM AND METHOD FOR SPEECH COMPRESSION AND DECOMPRESSION

[75] Inventor: Shelia Guberman, Cupertino, Calif.

[73] Assignee: Infolio, Inc., San Jose, Calif.

[21] Appl. No.: 09/265,914

[22] Filed: Mar. 10, 1999

[51] Int. Cl.[7] ..... G10L 11/04

[52] U.S. Cl. ..... 704/207; 704/208; 704/219; 704/220; 704/228; 704/500

[58] Field of Search ..... 704/207, 208, 704/500–504, 219, 228, 220

[56] References Cited

U.S. PATENT DOCUMENTS

| | | | |
|---|---|---|---|
| 3,387,093 | 6/1968 | Stewart . | |
| 3,462,555 | 8/1969 | Presti et al. . | |
| 4,435,831 | 3/1984 | Mozer . | |
| 4,435,832 | 3/1984 | Asada et al. . | |
| 4,631,746 | 12/1986 | Bergeron et al. . | |
| 4,661,915 | 4/1987 | Ott . | |
| 4,686,644 | 8/1987 | Renner et al. . | |
| 4,695,970 | 9/1987 | Renner et al. . | |
| 4,764,963 | 8/1988 | Atal . | |
| 4,782,485 | 11/1988 | Gollub . | |
| 4,792,975 | 12/1988 | MacKay . | |
| 4,796,216 | 1/1989 | Renner et al. . | |
| 4,870,685 | 9/1989 | Kadokawa et al. . | |
| 4,888,806 | 12/1989 | Jenkin et al. . | |
| 4,922,539 | 5/1990 | Rajasekaran et al. . | |
| 4,969,193 | 11/1990 | Scott et al. . | |
| 5,025,471 | 6/1991 | Scott et al. . | |
| 5,153,913 | 10/1992 | Kandefer et al. . | |
| 5,448,679 | 9/1995 | McKiel, Jr. . | |
| 5,536,902 | 7/1996 | Serra et al. | 84/623 |
| 5,615,298 | 2/1997 | Chen | 704/228 |
| 5,627,939 | 5/1997 | Huang et al. . | |
| 5,659,659 | 8/1997 | Kolesnik et al. . | |
| 5,696,875 | 12/1997 | Pan et al. . | |
| 5,701,391 | 12/1997 | Pan et al. . | |
| 5,710,863 | 1/1998 | Chen . | |
| 5,715,356 | 2/1998 | Hirayama et al. . | |
| 5,742,930 | 4/1998 | Howitt . | |
| 5,787,391 | 7/1998 | Moriya et al. . | |
| 5,873,059 | 2/1999 | Iijima et al. | 704/207 |
| 5,884,010 | 3/1999 | Chen et al. | 704/228 |

*Primary Examiner*—David R. Hudspeth
*Assistant Examiner*—Vijay B Chawan
*Attorney, Agent, or Firm*—Flehr Hohbach Test Albritton & Herbert

[57] ABSTRACT

The invention provides system, apparatus, and method for compressing a speech signal by decimating or removing somewhat redundant portions of the signal while retaining reference signal portions sufficient to reconstruct the signal without noticeable loss in quality, thereby permitting a storage and transmission of high quality speech with minimal storage volume or transmission bandwidth requirements. Speech pitch waveform decimation is used to reduce data to produce an encoded speech signal during compression, and time based interpolative speech reconstruction is used on the encoded signal to reconstruct the original speech signal. In one aspect, the invention provides a method for processing a speech signal that includes identifying portions of the speech signal representing individual speech pitches; generating an encoded speech signal from the speech pitches, the encoded speech signal retaining ones of the plurality of pitches and omitting other ones of the plurality of pitches; and generating a reconstructed speech signal by replacing each the omitted pitch with an interpolated replacement pitch having signal waveform characteristics which are interpolated from a first retained reference pitch occurring temporally earlier to the pitch to be interpolated and from a second retained reference pitch occurring temporally later than the pitch to be interpolated. In another aspect apparatus is provided to perform the speech compression and reconstruction method. In another aspect an internet voice electronic mail system is provided which has minimal voice message storage and transmission requirements while retaining high fidelity voice quality.

19 Claims, 7 Drawing Sheets

APPARATUS SYSTEM AND METHOD FOR SPEECH COMPRESSION AND DECOMPRESSION

FIELD OF INVENTION

This invention pertains generally to the field of speech compression and decompression and more particularly to system, apparatus, and method for reducing the data storage and transmission requirements for high quality speech using speech pitch waveform decimation to reduce data with temporal interpolative speech reconstruction.

BACKGROUND OF THE INVENTION

Human speech as well as other animal vocalizations consist primarily of vowels, non-stop consonants, and pauses; where vowels typically represent about seventy percent of the speech signal, consonants about fifteen percent, pauses about three percent, and transition zones between vowels and consonants the remaining twelve percent or so. As the vowel sound components form the biggest parts of speech, any form of processing which intends to maintain high-fidelity with the original (unprocessed) speech should desirably reproduce the vowel sounds or vowel signals correctly as much as possible. Naturally, the non-stop consonant, pauses, and other sound or signal components should desirably be reproduced with an adequate degree of fidelity so that nuances of the speaker's voice are rendered with appropriate clarity, color, and recognizability.

In the description here, we use the term speech "signal" to refer to the acoustic or air time varying pressure wave changes emanating from the speaker's mouth, or to the acoustic signal that may be reproduced from a prior recording of the speaker such as may be generated from a speaker or other sound transducer, or from an electrical signal generated from such acoustic wave, or from a digital representation of any of the above acoustic or electrical representations.

A time versus signal amplitude graph for an electrical signal representing an approximate 0.2 second portion of speech (the syllable "ta") is depicted in the graph of FIG. 4, which includes the consonant "t", the transition zone "t-a", and the vowel "a". The vowel and transition signal components comprise of a sequence of pitches. Each pitch represents the acoustic response of the articulator volume and geometry (that is the part of the respiratory tract generally located between and including the lips and the larynx) to an impulse of air pressure produced by the copula.

The frequency of copula contractions for normal speech is typically between about 80 and 200 contractions per second. The geometry of the articulator changes much slower than the copular contractions, changing at a frequency of between about four to seven times per second, and more typically between about five and six times per second. Therefore, in general, the articulator geometry changes very little between two adjacent consecutive copula contractions. As a result, the duration of the pitch and the waveform change very little between two consecutive pitches, and although somewhat more change may occur between every third or fourth pitch, such changes may still be relatively small.

Conventional systems and methods for reducing speech information storage have typically relied frequency domain processing to reduce the amount of data that is stored or transmitted. In one conventional approach to speech compression that relies on a sort of time domain processing, periods of silence, voiced sound, and unvoiced sound within an utterance are detected and a single representative voiced sound utterance is repeatedly utilized along with its duration to approximate each voiced sound along with the duration of each voiced sound. The spectral content of each unvoiced sound portions of the utterance and variations in amplitude are also determined. A compressed data representation of the utterance is generated which includes an encoded representation of periods of silence, a duration and single representative data frame for each voiced sound, and a spectral content and amplitude variations for each unvoiced sound. U.S. Pat. No. 5,448,679 to McKiel, Jr., for example, is an example speech compression of this type. Unfortunately, even this approach does not take into account the nature of human speech where the pattern of the vowel sound is not constant but rather changes significantly between pitches. As a result, the quality of the reproduced speech suffers significant degradation as compared to the original speech.

Therefore there remains a need for system, apparatus, and method for reducing the information or data transmission and storage requirements while retaining accurate high-fidelity speech.

SUMMARY OF THE INVENTION

Figure 1:
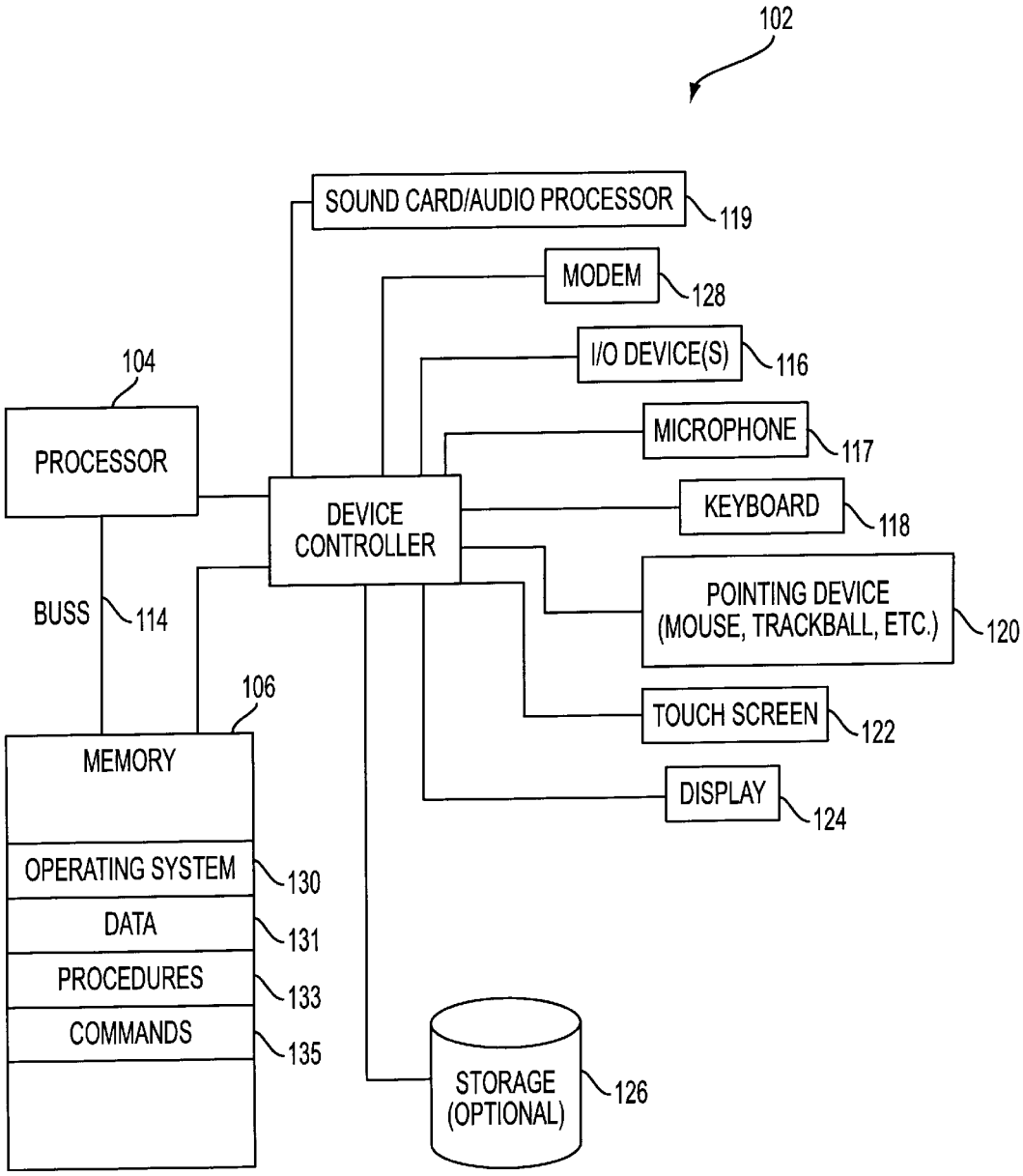
FIG. 1 is an illustration showing an embodiment of a computer system incorporating the inventive speech compression.

The invention provides system, apparatus, and method for compressing a speech signal by decimating or removing somewhat redundant portions of the signal while retaining reference signal portions that are sufficient to reconstruct the original signal without noticeable loss in quality, thereby permitting a storage and transmission of high quality speech or voice with minimal storage volume or transmission bandwidth requirements. Speech pitch waveform decimation is used to reduce data to produce an encoded speech signal during compression and time based interpolative speech reconstruction is used on the encoded signal to reconstruct the original speech signal.

In one aspect, the invention provides a method for processing a speech or voice signal that includes the steps of identifying a plurality of portions of the speech signal representing individual speech pitches; generating an encoded speech signal from a plurality of the speech pitches, the encoded speech signal retaining ones of the plurality of pitches and omitting other ones of the plurality of pitches, at least one speech pitch being omitted for each speech pitch retained; and generating a reconstructed speech signal by replacing each the omitted pitch with an interpolated replacement pitch having signal waveform characteristics which are interpolated from a first retained reference pitch occurring temporally earlier to the pitch to be interpolated and from a second retained reference pitch occurring temporally later than the pitch to be interpolated. In another aspect apparatus is provided to perform the speech compression and reconstruction method. In another aspect an internet voice electronic mail system is provided which has minimal voice message storage and transmission requirements while retaining high fidelity voice quality.

DETAILED DESCRIPTION OF THE EMBODIMENTS

The invention provides structure and method for reducing the volume of data required to accurately represent a speech signal without sacrificing the quality of the restored speech or sound generated from the reduced volume of speech data.

Reducing the amount of data needed to store, transmit, and ultimately reproduce high quality speech is extremely important. We will for lack of a better term describe such data reduction as "compression" while at the same time realizing that manner in which the volume or amount of data is reduced is different from other forms of speech compression, such as for example those that rely primarily on frequency domain sampling and/or filtering. It should also be understood that the inventive compression may be utilized in combination with conventional compression techniques to realize even greater speech data volume reduction.

Compression is particularly valuable when a voice message is to be stored digitally or transmitted from one location to another. The lower the data volume required to less valuable storage space or communication channel bandwidth and/or time burden such transmission will require. In consumer electronics devices, such as personal computers, information appliances, personal data assistants (PDA's), cellular telephones, and all manner of other commercial, business, or consumer products where voice may be used as an input or output, speech compression is advantageous for reducing memory requirements which can translate to reduced size and reduced cost. As a result of progress in telecommunications, the demand for high quality speech transmission becomes crucial for most commercial, business, and entertainment applications.

Voice e-mail, that is electronic mail that is or includes spoken voice presents a particularly attractive application for speech compression, particularly when such speech preserves the qualities of the individual speakers voice, rather than the so called "computer generated" speech quality conventionally provided. Voice e-mail benefits from both the reduced storage and reduced communications channel (for example, wired modem or wireless RF or optical) that speech compression can provide.

Assuming a 10 kilohertz sampling rate and one byte per sample (10 Kbyte/sec), a one-minute duration of spoken English may typically require about 0.6 MBytes of storage and when transmitted, a communications channel capable of supporting such a transmission. Where a computer, PDA, or other information appliance is adapted to receive speech messages, such as voice electronic mail (e-mail), it may be desirable to provide capability to receive and store from five to ten or more messages. Ten such one-minute messages, if uncompressed would require six megabytes of RAM storage. Some portable computers or other information appliances, such as for example the Palm Pilot III™, which is normally sold with about two megabytes of RAM and does not include other mass storage (such as a hard disk drive) would not be capable of storing six megabytes of voice e-mail. Therefore, speech compression by a factor of from about 4 to 6 times without loss of quality, and compression of 8 to 20 times or more with acceptable loss of quality is highly desirable, particularly if noise suppression is also provided.

A computer system 102 such as the computer system illustrated in FIG. 1, includes a processor 104, a memory 106 for storing data 131, commands 133, procedures 135, and/or operating system is coupled to the processor 104 by a bus or other interconnect structure 114. The operating system may for example be a disk based operating system such as Microsoft™ DOS, or Microsoft™ Windows (e.g. version 3.1, 3.11, 95, 98) Microsoft™ CE (versions 1.0, 2.0), Linux, or the like. Computer system 102 also optionally includes input/output devices 116 including for example, microphone 117, soundcard/audio processor 119, keyboard 118, pointing device 120, touch screen 122 possibly associated with a display device 124, modem 128, mass storage 126 such as rotating magnetic or optical disk, such as are typically provided for personal computers, information appliances, personal data assistants, cellular telephones, and the like devices and systems. The touch pad screen may also permit some handwriting analysis or character recognition to be performed from script or printed input to the touch screen. The computer system may be connected to or form a portion of a distributed computer system, or network, including for example having means for connection with the Internet.

One such computer system that may be employed for the inventive speech compression/decompression is described in co-pending patent application Ser. No. 08/970,343 filed Nov. 14, 1997 and titled Notebook Computer Having Articulated Display which is hereby incorporated by reference.

In one embodiment of the invention, a so called "thin client" that includes a processor, memory 106 such as in the form of ROM for storing procedures and RAM for storing data, modem, keyboard and/or touch screen is provided. Mass storage such as a rotatable hard disk drive is not provided in this thin client to save weight and operating power; however, mass storage in the form of one or more of a floppy disk storage device, a hard disk drive storage device, a CDROM, magneto optical storage device, or the like may be connected to the thin client computer system via serial, Universal Serial Bus (USB), SCSI, parallel, infrared or other optical link or other know device interconnect means. Advantageously, the thin client computer system may provide one or more PC Card (PCMCIA Card) ports or slots to provide connecting a variety of devices, including for example, PC Card type hard disk drives, of which several types are known, including a high-capacity disk drive manufactured by IBM. However, in order to maintain low power consumption and extend battery life, it may be desirable to generally operate the system without the additional optional devices, unless actually needed and in particular to rely on RAM to eliminate the power consumption associated with operating a hard disk drive.

Figure 2:
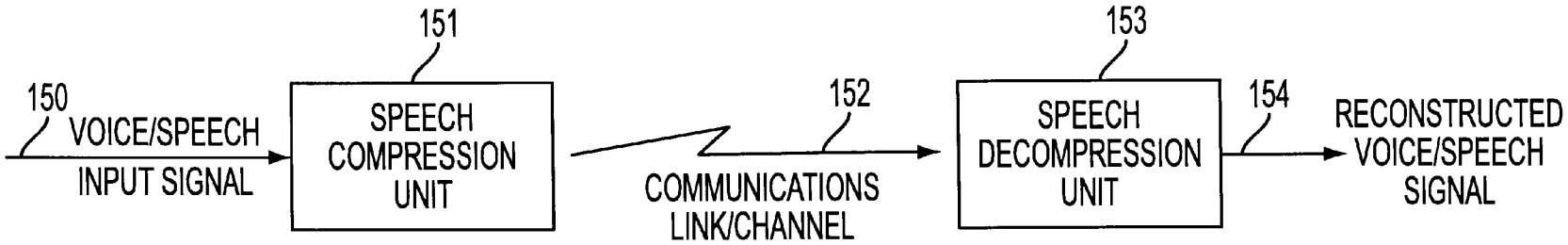
FIG. 2 is an illustration showing an embodiment of the compression, communication, and decompression/reconstruction of a speech signal.

One application for the inventive speech compression procedure is illustrated in FIG. 2, wherein a voice or speech input signal (or data) 150 is processed by the inventive speech compressor 151 and sent over a communications link or channel 152, such as a wireless link or the internet, to a receiver having a speech decompressor 153. Speech decompressor 153 generates a reconstructed version of the original speech signal 150 from the encoded speech signal (or data) received. The speech compressor and decompressor may be combined into a single processor, and the processor may be implemented either in hardware, software or firmware running on a general purpose computer, or a combination of the two.

Figure 3:
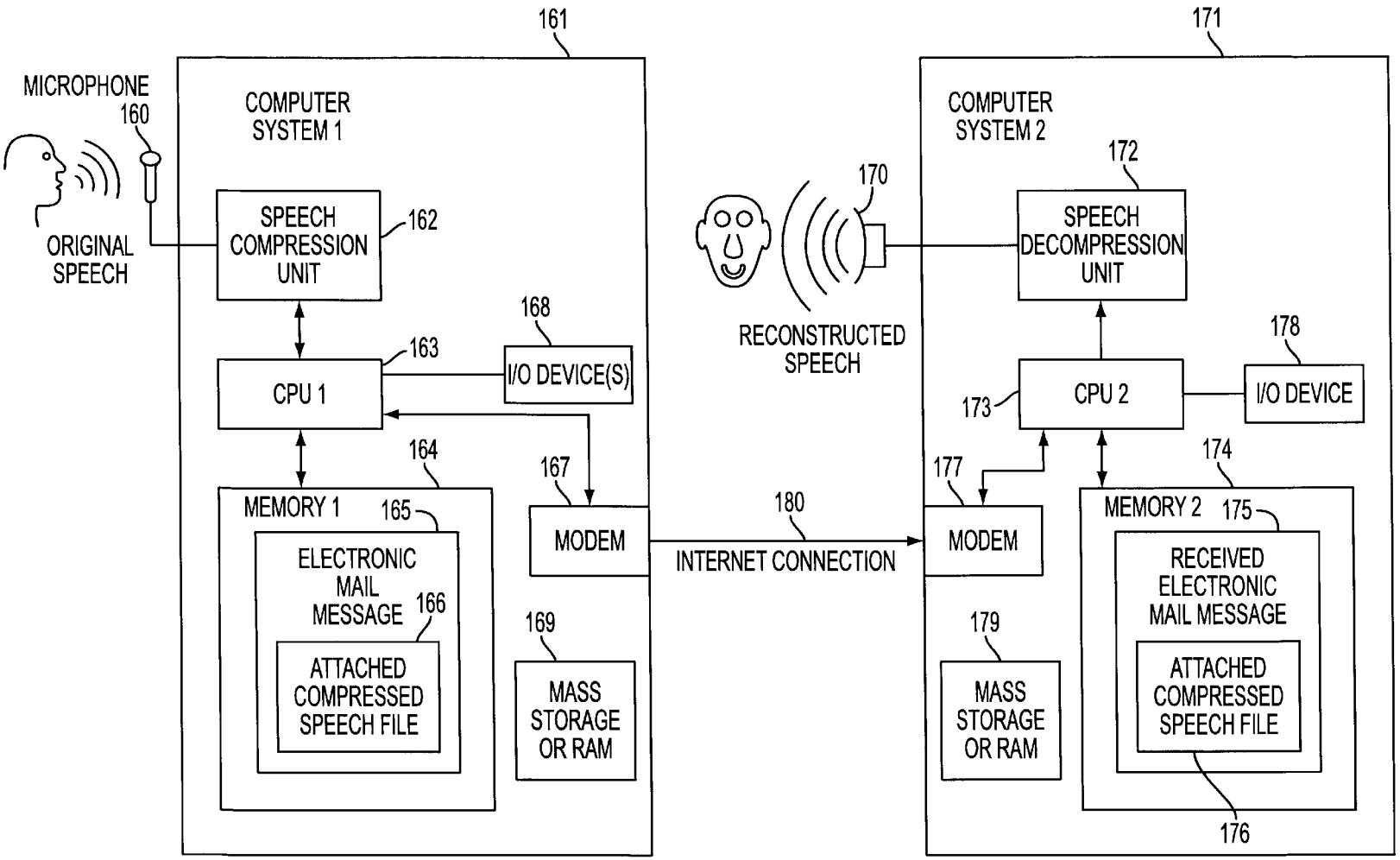
FIG. 3 is an illustration showing an embodiment of the invention in an internet electronic-mail communication system.

An alternative embodiment of the inventive structure and method is illustrated and described relative the diagrammatic illustration in FIG. 3. An acoustical voice or speech input signal is converted by a transducer 160, such as a microphone into a electronic signal that is fed to a speech compression processor 162. The speech compression processor may be implemented either in hardware, software or firmware running on a general purpose computer, or a combination of the two, and may for example be implemented by software procedures executing in a CPU 163 with associated memory 164. The compressed speech file is stored in memory 164, for example as an attachment file 166 associated with an e-mail message 165. E-mail message 165 and attached compressed speech file 166 is communicated via a modem 167 over a plurality of networked computers, such as the internet 180, to a receiving computer 171 where it is stored in memory 174. Upon opening the message 175, the attached file is identified as a compressed speech file decompressed by speech decompressor 172 to reconstruct the original speech prior to (or during) playback by a second transducer 170, such as a speaker.

Figures 4, 5, 6:
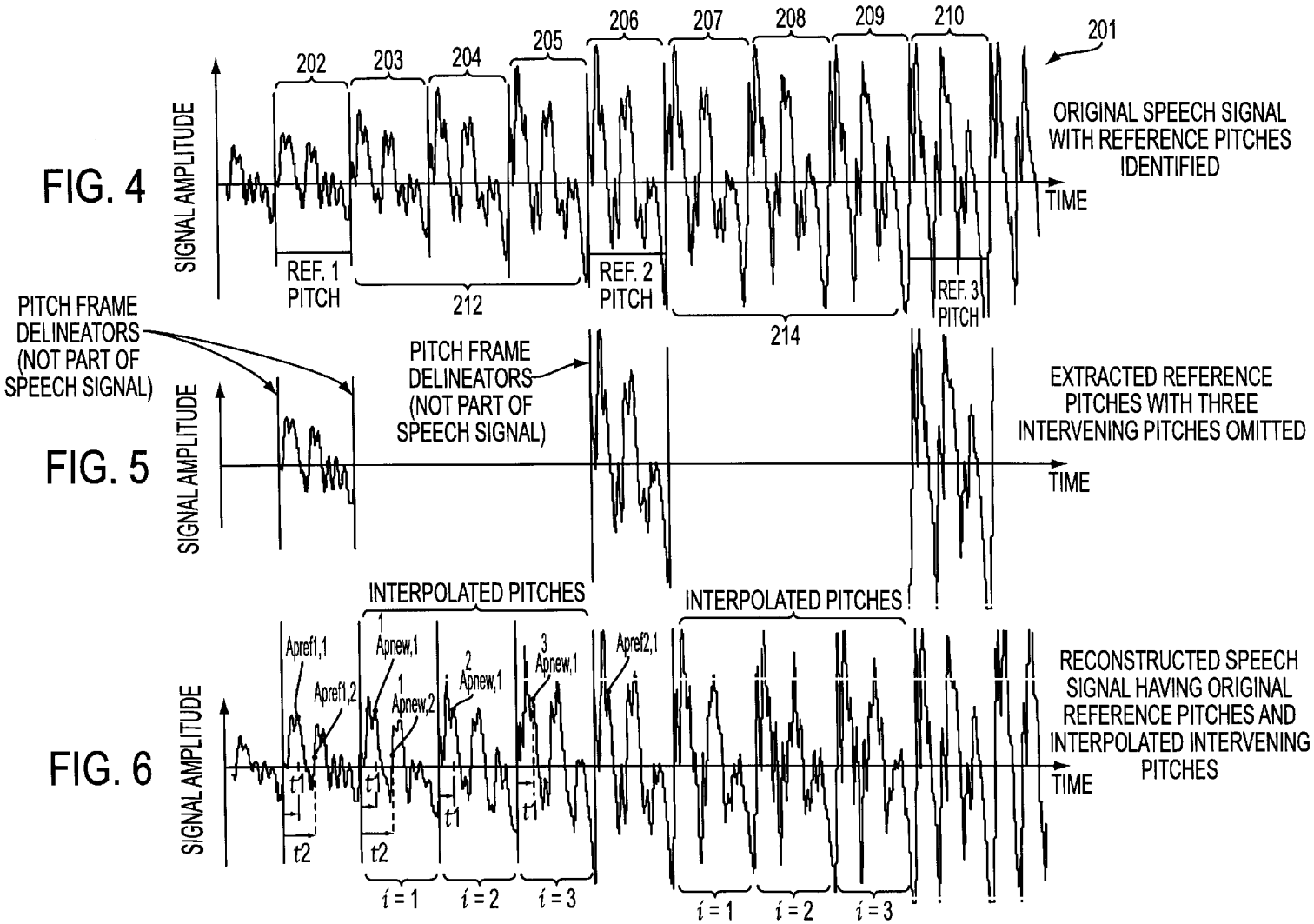
FIG. 4 is an illustration showing an original speech waveform prior to encoding.
FIG. 5 is an illustration showing the speech signal waveform in FIG. 4 with three pitches omitted between two reference pitches.
FIG. 6 is an illustration showing the reconstructed speech signal waveform in FIG. 4 with interpolated pitches replacing the omitted pitches.

We now describe embodiments of the inventive structure and method relative to the a speech waveform for the sound "ta" illustrated in FIG. 4. In a first embodiment of the inventive structure and method, n out of (n+1) pitches from an interval representing speech are omitted or removed to reduce the information content of the extracted speech. In the signal of FIG. 4, pitches 203, 204, 205, 207, 208, 209 are omitted from the stored or transmitted signal; while reference pitches 202, 206, and 210 are retained for storage or transmittal. Individual pitches are identified using a pitch detection procedure, such as that described relative to vowel and consonant pitch detectors 329, 330 hereinafter, or other techniques for selecting a repeating portion of a signal. Fundamentally, the pitch detection procedure looks for common features in the speech signal waveform, such as one or more zero crossings at periodic intervals. Since the waveform is substantially periodic, the location chosen as the starting point or origin of the pitch is not particularly important. For example, the starting point for each pitch could be a particular zero crossing or alternatively a peak amplitude, but for convenience we typically select the start of a pitch as a zero crossing amplitude. The particular pitches to be retained as reference pitches are selected from the identified pitches by a reference pitch selection procedure which identifies repeating structures in the speech waveform having the expected duration (or falling within an expected range of durations) and characteristics. Exemplary first, second, and third reference pitches 201, 202, 203 are indicated in FIG. 4 for the sound "ta." We note however, that the reference pitches identified in FIG. 4 are not unique and a different set of pitches could alternatively have been selected. Even the rules or procedures associated with reference pitch selection may change over time as long as the reference pitches accurately characterize the waveform.

Note that while we characterize the reduction in pitches as n of n+1 (or as n−1 of n) it should be understood that each contiguous group of omitted pitches is associated with two reference pitches, one proceeding the omitted pitches in time and one succeeding the omitted pitches in time, though not necessarily the immediately proceeding or succeeding pitches. These reference pitches being used to reconstruct an approximation or estimate of the omitted pitches as described hereinafter in greater detail.

This reduction of information may be referred to as a type of speech compression in a general sense, but it may also be though of as a decimation of the signal in that portions of the signal are completely eliminated (n of the n+1 pitches) and other portions (1 pitch of the n+1 pitches in any particular speech interval) referred to as reference pitches are retained. When k represents the fraction of the total speech that is occupied by vowels, this removal or elimination of n pitches out of every n+1 pitches allows reduction of the amount of speech that would otherwise be stored or transmitted by a compression factor or ratio C. One way to express the compression factor is by the equation for C given immediately below:

$$C = \frac{1}{1 - \left[k \times \frac{n}{n+1}\right]}$$

where k, and n are as described above. For example, for speech in which 70% of the speech is made up of vowel sounds (K=0.70), and four of every five pitches are eliminated, a compression factor C=2.2 would be achieved. As k increases, the compression factor increase since k represents the fraction of speech that can be compressed and 1−k the fraction of speech that cannot be compressed. Furthermore, as the number of omitted pitches increases as a fraction of the total number of pitches, the compression factor also increases. Alternative measures of the compression factor or compression ratio may be defined.

Reconstruction (or decompression) of a compressed representation of the original speech signal is achieved by restoring the omitted pitches in their proper timing relationship using interpolation between the retained pitches (reference pitches). In one embodiment of the invention, the interpolation includes a linear interpolation between the reference pitches using a weighting scheme. In this embodiment, for the i-th omitted pitch between two reference pitches the amplitudes of the waveform are calculated as follows:

$$A^{i}_{pnew,t} = \left[A_{pref1,t} \times \frac{(n+1-i)}{(n+1)}\right] + \left[A_{pref2,t} \times \frac{i}{(n+1)}\right]$$

Here, $A^{i}_{pnew,t}$ is the computed desired amplitude of the new interpolated pitch for the sample corresponding to relative time t; $A_{pref1,t}$ is the reference pitch amplitude of the first reference pitch at the corresponding relative time t; n is the number of pitches that have been omitted and which are to be reconstructed ($n \geqq i > 0$), and i is an index of the particular pitch for which the weighted amplitude is being computed. Time, t, is specified relative to the origin of each pitch interval. The manner in which the interpolated pitch calculations are performed for each omitted pitch from the two surrounding reference pitches are illustrated numerically in Table I. Note that in Table I, only selected samples are identified to illustrate the computational procedure; however, those workers having ordinary skill in the art will appreciate that the speech signal waveform should be sampled in accordance with conventional sampling requirements in accordance with well established sampling theory.

An illustrative example showing the original speech signal 201 with the locations of first, second, and third reference pitches 202, 206, 210; and two groups of intervening pitches 212, 214 which are to be omitted in a stored or transmitted signal is illustrated in FIG. 5. Intervening pitch groups 212 include pitches 203, 204, and 205; while intervening pitch group 214 includes pitches 207, 208, and 209. The reference pitches are stored or transmitted along with optional collateral information indicating how the original signal is to be reconstructed. The collateral information may, for example, include an indication of how many pitches have been omitted, what are the lengths of the omitted pitches, and the manner in which the signal is to be reconstructed. In one embodiment of the invention, the reconstruction procedure comprises a weighted linear interpolation between the reference pitches to regenerate an approximation to the omitted pitches, but other interpolations may alternatively be applied. It is noted that the reference pitches are not merely replicated, but that each omitted pitch is replaced by its reconstructed approximation. Non-linear interpolation between adjacent reference pitches may alternatively be used, or the reconstruction may involve some linear or non-linear interpolation involving a three or more reference pitches.

The biological nature of speech is well described by the science of phonology which characterizes the sounds of speech into one of four categories: (1) vowels, (2) non-stop consonants, (3) stop consonants, and (4) glides. The vowels and glides are quasi-periodical and the natural unit for presentation of that vowel part of speech is a pitch. The non-stop consonants are expressed by near-stationary noise signal (non-voiced consonant) and by a mix of stationary noise and periodical signal (voiced consonant). The stop consonants are mainly determined by a local feature, that is a jump in pressure (for non-voiced consonants) plus periodical signal (for voiced consonants).

TABLE I

Illustrative example for calculation of amplitudes (A) of omitted pitch samples for on reconstruction

| Amplitude | General Form: | |
|---|---|---|
| $A^{i}_{pnew,t}$ | $A^{i}_{pnew,t} = \left[A_{pref2,t} \times \frac{i}{(n+1)}\right] + \left[A_{pref1,t} \times \frac{(n+1-i)}{(n+1)}\right]$ | — |
| $A^{1}_{pnew1,t1}$ | $A^{1}_{pnew1,t1} = \left[A_{pref2,t1} \times \frac{1}{(4+1)}\right] + \left[A_{pref1,t1} \times \frac{(4+1-1)}{(4+1)}\right]$ | $A^{1}_{pnew1,t1} = \frac{1}{5}A_{pref2,t1} + \frac{4}{5}A_{pref1,t1}$ |
| $A^{1}_{pnew1,t2}$ | $A^{1}_{pnew1,t2} = \left[A_{pref2,t2} \times \frac{1}{(4+1)}\right] + \left[A_{pref1,t2} \times \frac{(4+1-1)}{(4+1)}\right]$ | $A^{1}_{pnew1,t2} = \frac{1}{5}A_{pref2,t2} + \frac{4}{5}A_{pref1,t2}$ |
| $A^{1}_{pnew1,t3}$ | $A^{1}_{pnew1,t3} = \left[A_{pref2,t3} \times \frac{1}{(4+1)}\right] + \left[A_{pref1,t3} \times \frac{(4+1-1)}{(4+1)}\right]$ | $A^{1}_{pnew1,t3} = \frac{1}{5}A_{pref2,t3} + \frac{4}{5}A_{pref1,t3}$ |
| $A^{1}_{pnew1,t4}$ | $A^{1}_{pnew1,t4} = \left[A_{pref2,t4} \times \frac{1}{(4+1)}\right] + \left[A_{pref1,t4} \times \frac{(4+1-1)}{(4+1)}\right]$ | $A^{1}_{pnew1,t4} = \frac{1}{5}A_{pref2,t4} + \frac{4}{5}A_{pref1,t4}$ |
| | . . . | . . . |
| $A^{2}_{pnew2,t1}$ | $A^{2}_{pnew2,t1} = \left[A_{pref2,t1} \times \frac{2}{(4+1)}\right] + \left[A_{pref1,t1} \times \frac{(4+1-2)}{(4+1)}\right]$ | $A^{2}_{pnew2,t1} = \frac{2}{5}A_{pref2,t1} + \frac{3}{5}A_{pref1,t1}$ |
| | . . . | . . . |
| $A^{3}_{pnew3,t1}$ | $A^{3}_{pnew3,t1} = \left[A_{pref2,t1} \times \frac{3}{(4+1)}\right] + \left[A_{pref1,t1} \times \frac{(4+1-3)}{(4+1)}\right]$ | $A^{2}_{pnew3,t1} = \frac{3}{5}A_{pref2,t1} + \frac{2}{5}A_{pref1,t1}$ |
| | . . . | . . . |
| $A^{4}_{pnew4,t1}$ | $A^{4}_{pnew4,t1} = \left[A_{pref2,t1} \times \frac{4}{(4+1)}\right] + \left[A_{pref1,t1} \times \frac{(4+1-4)}{(4+1)}\right]$ | $A^{4}_{pnew4,t1} = \frac{4}{5}A_{pref2,t1} + \frac{1}{5}A_{pref1,t1}$ |
| $A^{4}_{pnew4,t2}$ | $A^{4}_{pnew4,t2} = \left[A_{pref2,t2} \times \frac{4}{(4+1)}\right] + \left[A_{pref1,t2} \times \frac{(4+1-4)}{(4+1)}\right]$ | $A^{4}_{pnew4,t2} = \frac{4}{5}A_{pref2,t2} + \frac{1}{5}A_{pref1,t2}$ |
| $A^{4}_{pnew4,t3}$ | $A^{4}_{pnew4,t3} = \left[A_{pref2,t3} \times \frac{4}{(4+1)}\right] + \left[A_{pref1,t3} \times \frac{(4+1-4)}{(4+1)}\right]$ | $A^{4}_{pnew4,t1} = \frac{4}{5}A_{pref2,t1} + \frac{1}{5}A_{pref1,t1}$ |
| | . . . | . . . |

The inventive speech compression derives from the recognition of these characteristics. Because the articulator geometry changes slowly, the adjacent pitches are very similar to their neighbors and any pitch can readily be reconstructed from its two neighbors very precisely. In addition, not only is a pitch related to its nearest neighbor (the second consequent pitch), but is also related to at least the third, fourth, and fifth pitch. If some degradation can be tolerated for the particular application, sixth, seventh, and subsequent pitches may still have sufficient relation to be used. An example of the reconstructed speech signal is illustrated in FIG. 6 which shows a signal formed by the reference pitches and the interpolated intervening pitches to replace the omitted pitches.

The inventive structure and method do not depend on the particular language of the speech or on the definitions of the vowels or consonants for that particular language. Rather, the inventive structure and method rely on the biological foundations and fundamental characteristics of human speech, and more particularly on (i) the existence of pitches, and (ii) the similarities of adjacent pitches as well as the nature of the changes between adjacent pitches during speech. It is useful to realize that while many conventional speech compression techniques are based on "signal processing" techniques that have nothing to do with the biological foundations or the speech process, the inventive structure and method recognize the biological and physiological basis of human speech and provide a compression method which advantageously incorporates that recognition.

The inventive structure and method therefore do not rely on any definition as to whether a vocalization is considered to be a vowel, consonant, or the like. Rather, the inventive structure and method look for pitches and process the speech according to the pitches and the relationships between adjacent pitches.

In the English language, for example, the ten vowels are usually denoted by the symbols ă, ā, ĕ, ē, ĭ, ī, ŏ, ō, ŭ, ū where the notation above each character identifies the sound as the "short" or "long" variation of the vowel sound. However, the inventive structure and method are not limited to these traditional English language vowels, and some non-stop consonants, such as the "m", "n", and "l" sounds have the time structure similar to the vowels except that they typically have lower amplitudes than the vowels, will be processed in the same manner as the other vowels. These sounds are sometimes referred to as pseudo-vowels. Furthermore, the inventive structure and method apply equally well to speech vocalizations in French, Russian, Japanese, Mandarin, Cantonese, Korean, German, Swahili, Hindi, Farsi, and other languages without fundamental limitation.

The consonants are represented in the speech signal by intervals from about 20 milliseconds to about 40 milliseconds long. Pauses (periods of silence) also occupy a significant part of human speech.

Because of the stationarity of the noise with which the non-stop consonants may be represented, the most part of these intervals can be omitted to reduce the data content, and later restored by repeating a smaller part of the sampled stationary noise (for non-voiced consonant) and by restoring the noise plus the periodical signal for the voiced consonants. For the stop consonants the noisy component (the jump in the signal amplitude) is very short (typically less than about 20 milliseconds) and cannot usually be reduced.

In typical speech, only from about ten to fifteen percent (10% to 15%) of the speech signal involves rapidly changing articulatory geometry—the stop consonants, transitions between the consonants, and transitions between the vowels, other components of speech do not involve rapidly changing articulary geometry. By rapidly changing articulary geometry, we generally mean changes that occur on the order of the length (or time duration) of a single pitch.

One advantage of the inventive structure and method is the high quality or fidelity of the reconstructed or restored speech as compared to speech compressed and then reconstructed by conventional methods. In conventional structure and methods known to the inventor, particularly those involving a type of compression, the restored speech signal is less complicated (and is effectively low-pass filtered to present fewer high frequency components) than the input signal prior to compression in each part of the reconstructed signal.

By comparison, a speech signal processed according to a first embodiment of the inventive method is not less complicated (low-pass filtered) at every portion of the reconstructed signal. In fact, the reference pitches are kept intact with all nuances of the original speech signal, and the interpolated pitches (omitted from the input signal) are very close to the original pitches due to high degree of similarity, particularly respective of frequency content, between adjacent pitches. We note that the amplitude variation, typically observed between adjacent pitches will be compensated by the weighted interpolation described hereinabove. It is found empirically, that the individuality of a spoken voice is fully retained until the number of omitted pitches exceeds from about 4 to 6 (n=4, n=5, or n=6) and that up until n=7 or n=8 the quality of the reconstructed speech may still be as good as conventional speech compression methods. This means that the voice can be compressed by at least about 4–5 times without any noticeable loss of quality.

In one embodiment of the invention, a correlation coefficient (for example the correlation coefficient may be selected such that it is maintained in the range of 0.95, 0.90, 0.85, or some other value) is computed between pitches that might be omitted, and if the correlation coefficient falls below some predetermined value that is selected to provide the desired quality of speech for the intended application, that pitch is not omitted. The method is self adaptive so that the number of omitted pitches is adjusted on the fly to maintain required speech quality. In this approach, the number of omitted pitches may vary during the speech processing, for example, n may vary between n=3 and n=6; and the goal is to keep a predetermined quality to the speech and adapt to the speech content in real time or near real time.

In another embodiment of the invention, the user may specify the quality of reproduction required so that if the receiver or user is a thin client with minimal storage capabilities, that user may specify that the speech is to be compressed by omitting as many pitches as possible so that the information is retained but characteristics of the speaker are lost. While this might not produce the high-fidelity which the inventive structure and method are capable of providing, it would provide a higher compression ratio and still permit the information to be stored or transmitted in a minimal data volume. An graphical user interface, such as a button or slider on the display screen, may be provided to allow a user to readily adjust the quality of the speech.

Additional data reduction or compression may be achieved by applying conventional compression techniques, such as frequency domain based filtering, resampling, or the like, to reduce stored or transmitted data content even further. The inventive compression method which can provide a compression ratio of between 1:1 and about 4:1 or 6:1 without visible degradation, more typically less than 5:1 with small degradation, and between about 6:1 and 8:1 with minimal degradation, and between about 8:1 and about 20:1 or more with some degradation that may or may not be acceptable depending upon the application. Conventional compression methods may typically provide compression ratios on the order of about 8:1 and about 30:1. The inventive method may be combined with these conventional methods to achieve overall compression in the range of up to about 100:1, but more typically between about 8:1 and about 64:1, and where maintaining high-fidelity speech is desired from about 8:1 and about 30:1. When combining the inventive speech compression eliminating four of every five pitches and a conventional toll quality speech compression procedure that would achieve a compression ratio of about 8:1, an overall compression ratio on the order of 40:1 may be achieved with levels of speech quality that are comparable to the speech signal that would be obtained using conventional compression alone at a compression ratio of only 12:1. Stated another way, the inventive method will typically provide better quality speech than any other known conventional method at the same overall level of compression, or speech quality equal to that obtained with conventional methods at a higher level of compression.

Other advantages of the inventive deconstruction-reconstruction (compression-decompression) method include: (a) a relatively simple encoding procedure involving identifying the pitches so that the reference pitches may be isolated for storage or transmission; (b) a relatively simple decoding procedure involving placing the reference pitches in proper time relationship and interpolating between the reference pitches to regenerate the omitted pitches; and (c) reconstruction of higher quality speech than any other known technique for the same or comparable level of compression.

Dynamic Speech Compression with Memory may be accomplished in another embodiment of the invention, wherein additional levels of compression are realized by applying a learning procedure with memory and variable data dependent speech compression.

In the aforedescribed inventive compression method, each reference pitch present is stored or transmitted and the method or system retains no memory of speech waveforms or utterances it encountered in the past. In this alternative embodiment, the inventive structure and method provide some memory capability so that some or all reference pitches that have been encountered in the past are kept in a memory. The number of reference pitches that are retained in memory may be selected on the basis of the available memory storage, the desired or required level of compression, and other factors as described below. While one may first suspect that this might require an unreasonably large amount of memory to store such reference pitches, it is found empirically for the English and Russian languages that even for a large or temporally long duration of speech by a single person, the number of different pitch waveforms is finite, and in fact there are only on the order of about one hundred to about two hundred or so different pitch waveforms that derive from about ten different waveforms for each of the vowel and pseudo-vowel sounds. As the physiological basis for human speech is common even for diverse language families, it is expected that these relationships will hold for the spoken vowel sounds of other languages, such as for example, German, French, Chinese, Japanese, Italian, Spanish, Swedish, Arabic, and others, as well. These finite number of reference pitch waveforms can be numbered or otherwise tagged with an identifier (ID) for ready identification, and rather than actually transmitting the entire pitch waveform, only ID or tag need be stored or transmitted for subsequent speech reconstruction. The other non-stop consonants can be identified, stored, and processed in similar manner.

Usually after a short period of time, that is somewhat dependent on the nature of the speakers words, but typically from about one-half minute to about 5 minutes and more typically between about one minute and about two minutes, the inventive method will recognize that more and more of the reference pitches received are the same as or very similar to ones encountered earlier and stored in memory. In that case the system will not transfer the reference pitch just encountered in the speech, but instead transfer only his number or other identifier. In an alternative embodiment, the quality of the decompressed speech is improved further if in addition to the identifier of the particular reference pitch an optional indication of the difference between the original pitch and the stored reference pitch is stored or transmitted.

In one embodiment, the difference is characterized by a difference signal which at each instant in time identifies the difference between the portion of the pitch signal being represented and the selected reference pitch, this difference may be positive or negative. One advantage of this type of representation is that typically the number of bits available to represent a signal is limited and must cover the maximum peak-to-peak signal range expected. Whether 8, 10, 12, or 16 or more bits are available, there is some quantization error associated with a digital representation of the signal. The relationship between one pitch and one or more adjacent pitches has already been described, and it is understood that differences in adjacent pitches increase gradually as the separation between the pitches increases. Therefore, a difference signal can be represented more precisely in a given number of bits (or A/D, D/A levels) than the entire signal, or alternatively, the same level of precision can be represented by fewer bits for a difference signal pitch representation than by repeating the representation of the entire pitch signal. Typically, transmitting the difference signal rather than merely interpolating between reference signals in the manner described may provide even higher fidelity, but provision of structure and method for providing the difference signal are optional enhancements to the basic method.

It will be appreciated that some insubstantial variation may occur between pitches that actually represent the same speech. These slight variations may for example be caused by background noise, variations in the characteristic of the communications channel, and so forth and are of magnitude and character that are either not the result of intended variations in speech, not significant aspects of the speakers individuality, or otherwise not important in maintaining high speech fidelity, and can therefore be ignored. In order to reduce the number of stored reference waveforms, similar waveforms may be classified and grouped into a finite number of classes using conventional clustering techniques adapted to the desired number of cluster classes and reference signal characteristics.

The optional reference pitch clustering procedure can be performed for each of the deconstruction (compression) portion of the inventive method and/or for the reconstructive (decompression) portion of the inventive method. The ultimate quality of the reproduced speech may be improved if a large number of classes are provided; however, greater storage efficiency will be achieved by reducing the number of classes. Therefore, the number of classes is desirably selected to achieve the desired speech quality within the available memory allocation.

When the inventive speech compression is implemented with the memory feature, a compression factor of from about 10:1 to about 20:1 is possible without noticeable loss of speech quality, and compression ratios of as much as 40:1 can be achieved while retaining the information in the speech albeit with some possible loss of aspects of the individual speaker's voice.

We now turn our attention to an embodiment of the inventive structure and describe aspects of the method and operation relative to that structure.

Figure 7:
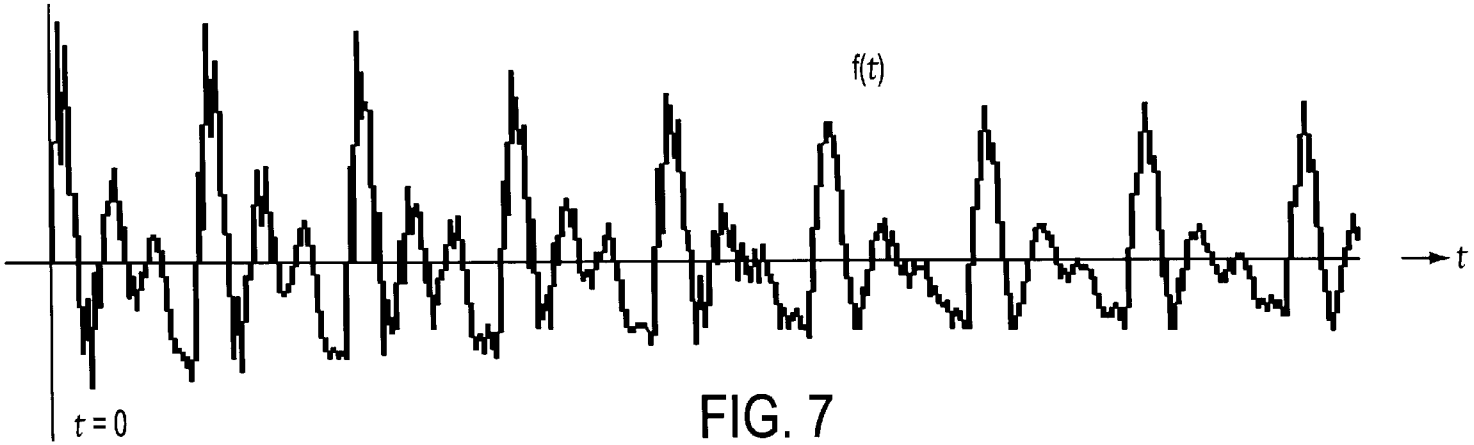
FIG. 7 is an illustration showing a second speech signal waveform useful for understanding the autocorrelation and pitch detection procedures associated with an embodiment of the speech processor.
Figure 8:
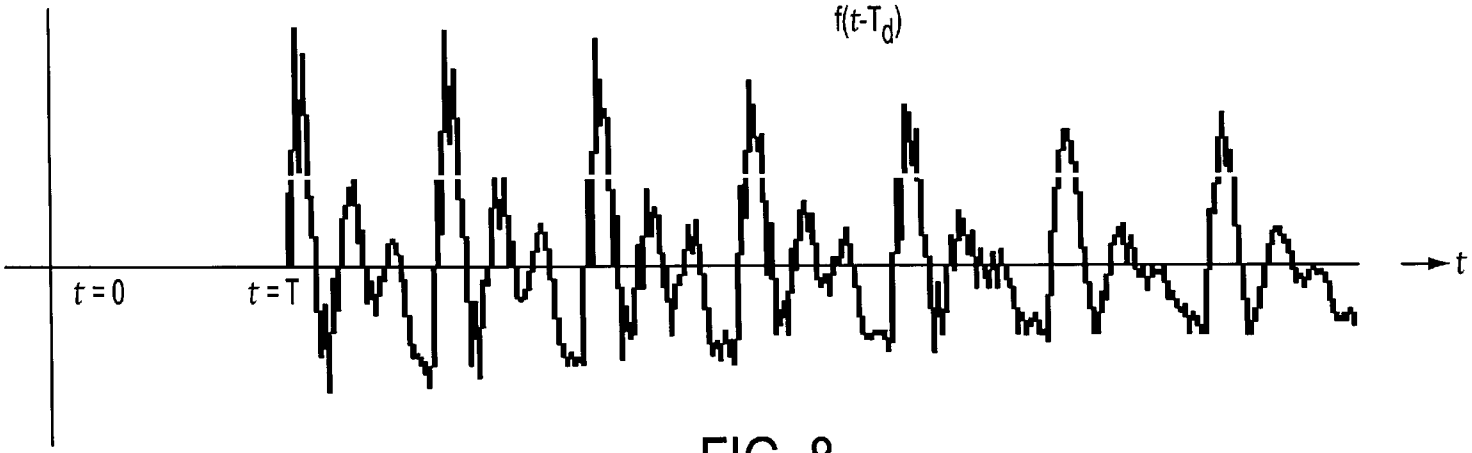
FIG. 8 is an illustration showing a delayed speech signal waveform in FIG. 7.

FIG. 7 is representation of a speech signal waveform f(t), and FIG. 8 is a representation of the a version of the same waveform in FIG. 7 shifted in time by an interval T, and denoted $f(t-T_d)$. One may consider that the signals are continuous analog signals even though the representation is somewhat coarse owing to the simulation parameters used in the analysis that follows.

Figure 9:
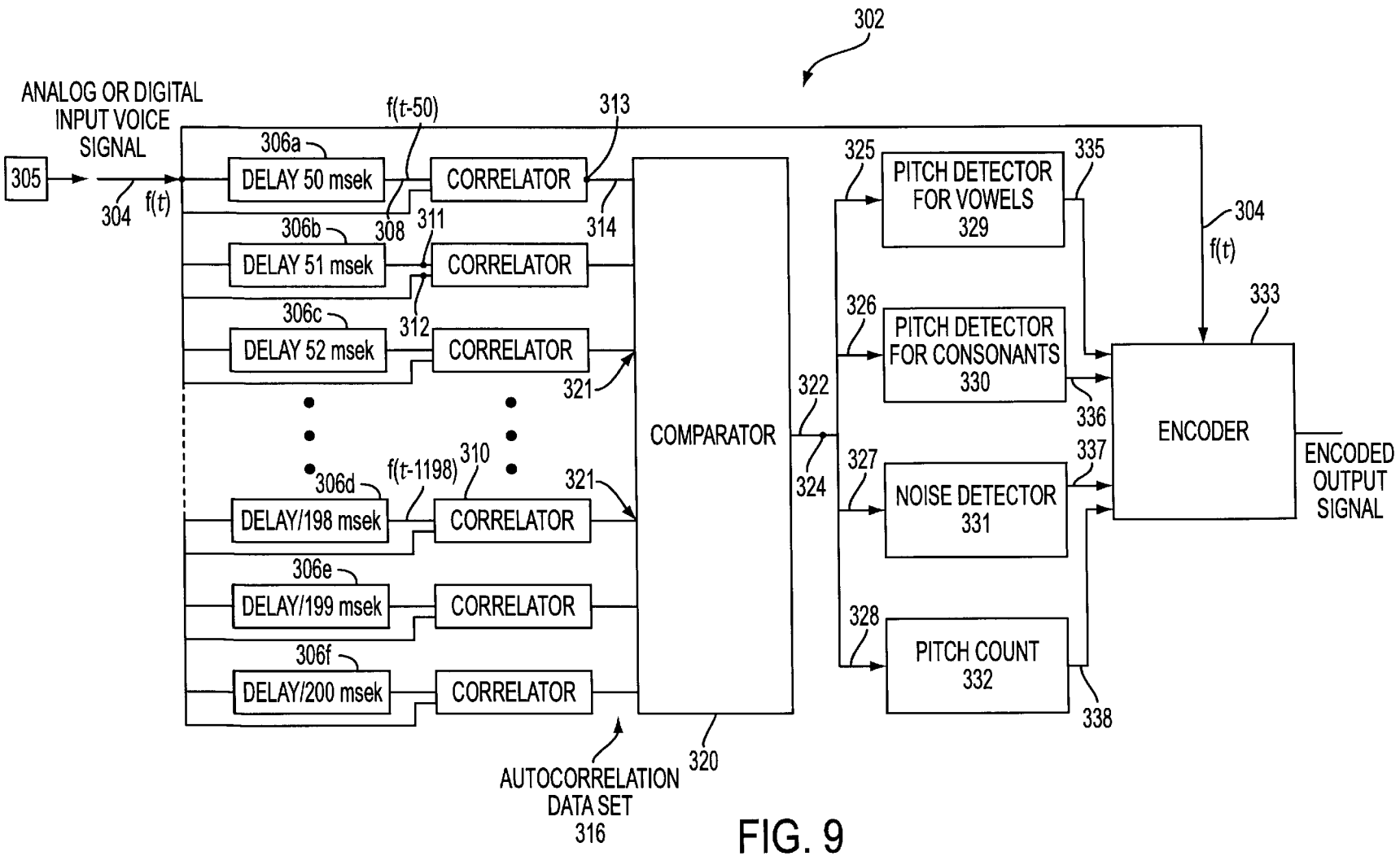
FIG. 9 is an illustration showing a functional block diagram of an embodiment of the inventive speech processor.

FIG. 9 is an illustration of an embodiment of a speech processor 302 for compressing speech according to embodiments of the invention. An analog or digital voice signal 304 is received as an input from an external source 305, such as for example from a microphone, amplifier, or some storage means. The voice signal is simultaneously communicated to a plurality (n) of delay circuits 306, each introducing some predetermined time delay in the signal relative to the input signal. In the exemplary embodiment, the delay circuits provide time delays in the range of from about 50 msec to about 1200 msec in some increment increments. In the exemplary embodiment an increment of 1 msec is used. The value of the smallest delay (here 50 msec) is chosen to be shorter than the shortest human speech pitch expected while the largest delay should be at least on the order of about five times larger than the largest human pitch. We refer to the original input signal as f(t) and to the delayed signal as $f(t-T_d)$.

Figure 10:
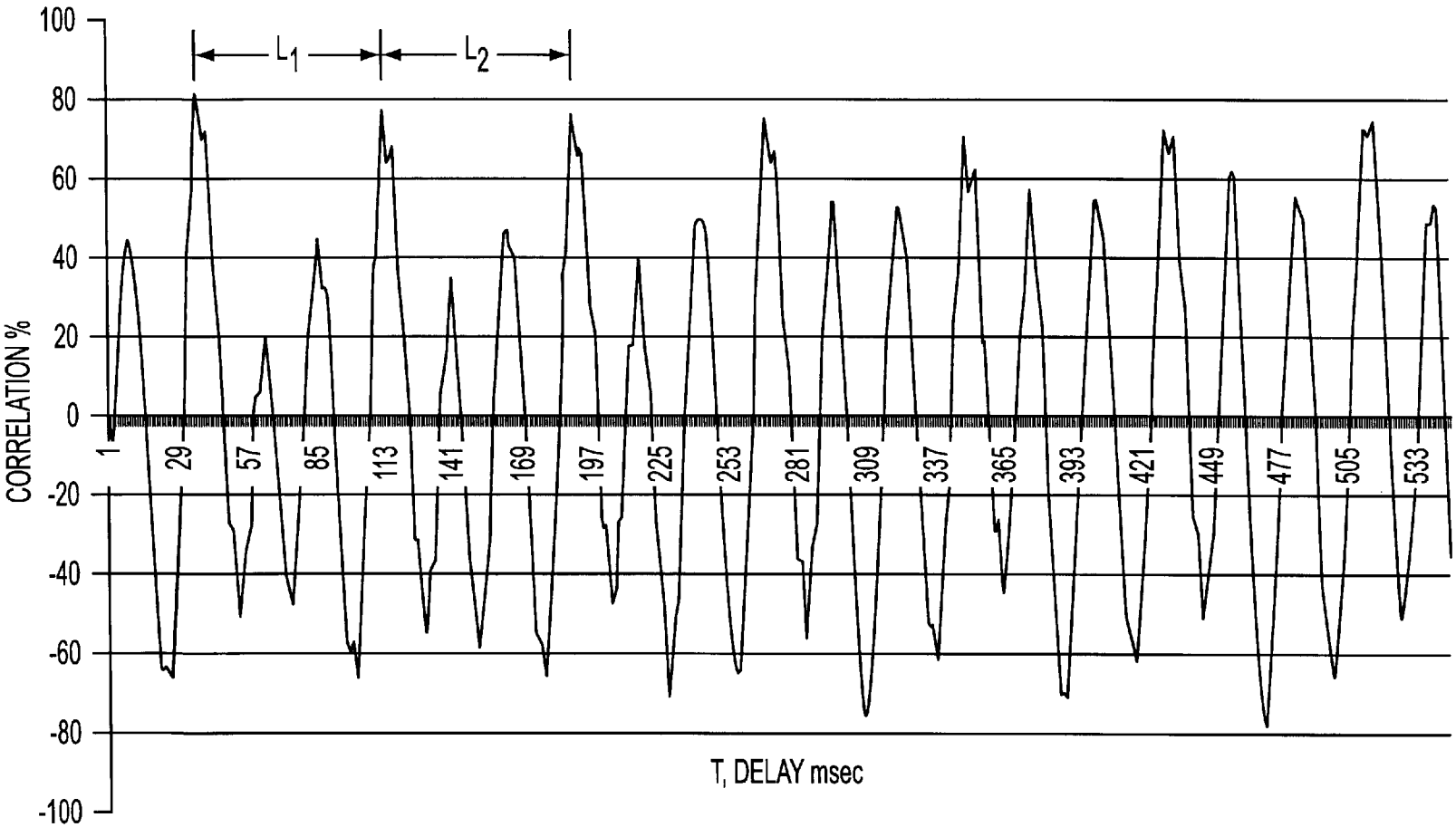
FIG. 10 is an illustration showing the autocorrelation function and the manner in which pitch lengths are determined.

The delayed output $f(t-T_d)$ 308 of each delay circuit 306 is coupled to a first input port 311 of an associated one of a plurality of correlator circuits 310, each of correlator circuits also receives at a second input port 312 an un-delayed f(t) version of the analog input signal 304. The number of correlator circuits is equal to the number of delay circuits. Each correlator circuit 308 performs a correlation operation between the input signal f(t) and a different delayed version of the input signal (for example, f(t−50), f(t−100), and so on) and generates the normalized autocorrelation value $F(t, T_d)$ as the correlator output signal 314 at an output port 313. The plurality of correlator circuits 310 each generate a single value $F(t, T_d)$ at a particular instant of time representing the correlation of the signal with a delayed version of itself (autocorrelation), but the plurality of correlator circuits cumulatively generate values representing the autocorrelation of the input signal 304 at a plurality of instants of time. In the exemplary embodiment, the plurality of correlator circuits generate an autocorrelation signal for time delays (of signal shifts) of from 50 msec to 1200 msec, with 1 msec increments. An exemplary autocorrelation signal is illustrated in FIG. 10, where the ordinate values 1–533 are indicative of the delay circuit rather than the delay time. For example, the numeral "1" on the ordinate represents the 50 msec delay, and only a portion of the autocorrelation signal is shown (sample 533 corresponding to a time delay of about 583 msec.)

The speech signal f(t) has a repetitive structure over, at least over short intervals of speech, so it is not unexpected that the autocorrelation of the signal 304 with delayed versions of itself 308 also has a repetitive oscillator and quasi-periodic structure over the same intervals. We further note that as the signal 304 is fed into the delay circuits and correlator circuits in a continuous manner, the correlator circuits generate an autocorrelation output set 316 for each instant of time. The autocorrelation values are received by a comparator circuit 320 at a plurality of input ports 321 and the comparator unit compares all the values of F(t, Td) from the correlators and finds local maximums. The output of comparator 320 is coupled to the inputs 325, 326, 327, and 328 of a vowel pitch detector 329, consonant pitch detector 330, noise detector 331, and pitch counter 332.

Vowel pitch detector 329 is a circuit which accepts the comparator output signal and calculates the pitch length for relatively high amplitude signals and large values (>F0) of the correlation function that are typical for vowel sounds. The vowel pitch length $L_v$ is the distance between two local maximums of the function $F(t, T_L)$ which fit the following three conditions: (i) pitch length $L_v$ is between 50 and 200 msec, (ii) the adjusted pitches differ not more than about five percent (5%), and (iii) the local maximums of the function $F(t, T_d)$ that marks the beginning and the end of each pitch are larger than any local maximums between them (See Autocorrelation in FIG. 10). These numerical ranges need not be observed exactly and considerable flexibility is permitted so long as the range is selected to cover the range of the expected pitch length. The vowel pitch length $L_v$ is communicated to the encoder 333.

Consonant pitch detector 330 is a circuit which accepts the comparator output signal and calculates the consonant pitch length $L_c$ for relatively low amplitude signals and small values (<F0) of the correlation function that are typical for consonant sounds. In effect the consonant pitch detector determines the pitch length when the comparator output is relatively low suggesting that the speech event was a consonant rather than a vowel. The consonant pitch detector generates an output signal that is used when: (i) the input signal is relatively low, (ii) the values of the correlation function are relatively low (<F0). The conditions for finding the pitch length are the same as for the vowel pitch detector with the addition of an additional step. Consonant pitch length Lc is determined by finding the distance between two local maximums of the function $F(t,T_L)$ which fit the following four conditions: (i) Pitch length $L_c$ is between 50 and 200 msec, (ii) the adjusted pitches differ not more than about five percent, (iii) the local maximums of the function $F(t,T_d)$ that marks the beginning and the end of each pitch are larger than any local maximums between them, and (iv) the pitch length has to be close to (within some predetermined epsilon value of) the last pitch length determined by the vowel pitch detector (or to the first pitch length determined by the vowel pitch detector after the consonant's pitch length was determined).

The consonant pitch detector works for voiced consonants, and works when the vowel pitch detector does not detect a vowel pitch. On the other hand, if the signal strength is lower so as not to trigger an vowel pitch event, the output of the consonant pitch detector is used. In one embodiment, the difference in sensitivity may be seen as hierarchical, in that if the signal strength is sufficient to identify a vowel pitch, the output of the vowel pitch detector is used. Different thresholds (a "vowel" correlation threshold (Tcv) and a "consonant" correlation threshold (Tcc)) may be applied relative to the detection process. In practice, determining the pitch is more important than determining that the detected pitch was for a vowel or for a consonant. While we have for purposes of describing the vowel pitch detector 329 and the consonant pitch detector 330, and differentiated vowel pitch length $L_v$ and consonant pitch length $L_c$, these distinctions are at least somewhat artificial and hence forth we merely refer to the pitch length L without further differentiation as to its association with vowels or consonants.

Noise detector 331 is a circuit which accepts the comparator output signal and generates an output signal that is used when the vowel pitch detector 329 is silent (does not detect a vowel pitch). Noise detector 331 analyzes the non-correlated (noisy) part of the voice signal and determines the part of the voice signal that should be included as a representation in the encoded signal. This processing follows from our earlier description that the non-stop consonants can be expressed by near-stationary noise signal (non-voiced consonant) and by a mix of stationary noise and periodical signal (voiced consonant), and that because of the stationarity of the noise with which the non-stop consonants may be represented, the most part of these intervals can be omitted to reduce the data content, and later restored by repeating a smaller portion of the sampled stationary noise, or alternatively, each of the voiced consonants can be represented by a signal representative of an appropriate stationary noise waveform. The output of noise detector 331 is also fed to the encoder 333.

Pitch counter 332 is a circuit which compares the values of the auto-correlation function for a sequence of pitches (consequential pitches) and determines when the value crosses some predetermined threshold (for example, a threshold of 0.7 or 0.8). When the value of the autocorrelation function drops below the threshold, a new reference pitch is used and the pitch counter 332 identifies the number of pitches to be omitted in the encoded signal.

The outputs 335, 336, 337, and 338 of vowel pitch detector 329, consonant pitch detector 330, noise detector 331, and pitch counter 332 are communicated to encoder circuit 333 along with the original voice signal 304. Encoder 333 functions to construct the final signal that will be stored or transmitted. The final encoded output signal includes a reference part of the original input signal f(t), such as a reference pitch of a vowel, and the number of pitches that were omitted (or the length of the consonant.)

Operationally, a correlation threshold value is chosen which represents the lowest acceptable correlation between the last reference pitch transmitted and the current speech pitch that is being analyzed to determine if it can be eliminated, or if because the correlation with the last sent reference pitch is too low, a new reference pitch should be transmitted.

The relationship of the correlation threshold value (Tc) to the autocorrelation result is now described relative to the autocorrelation signal in FIG. 10. The correlation threshold is selected based on the fidelity needs of the storage or communication system. When very high quality is desired, it is advantageous to store or transmit a reference pitch more frequently than when only moderate or low speech fidelity representation is needed. For example, setting the correlation threshold value to 0.8 would typically require more frequent transmission of a reference pitch than setting the correlation threshold value to 0.7, which would typically require more frequent transmission of a reference pitch than setting the correlation threshold value to 0.6, and so on. Normally it is expected that correlation threshold values in the range of from about 0.5 to 0.95 would be used, more particularly between about 0.6 and about 0.8, and frequently between about 0.7 and 0.8, but any value between about 0.5 and 1.0 may be used. For example, correlation threshold values of 0.5, 0.55, 0.6, 0.65, 0.7, 0.75, 0.8, 0.85, 0.9, 0.95, 0.99 may be used or any value intermediate thereto. Even values less than 0.5 may be used where information storage or transmission rather than speech fidelity is the primary requirement.

In one embodiment, we compare the local extrema of the autocorrelation function within some predetermined interval where the next pitch is expected. The expected delay between adjacent pitches can also be adaptive based on the characteristics of some past interval of speech. These local extrema are then compared to the chosen correlation threshold, and when the local extrema falls below the correlation threshold a new reference pitch is identified in the speech signal and stored or transmitted.

Empirical studies have verified that the length of pitches remains substantially the same over an interval of speech when determined in the manner described. For example, in one set of observations the pitch length was typically in the range of from about 65 msec to about 85 msec, and even more frequently in the range of from about 75 msec to about 80 msec.

An alternative scheme is to pre-set the number of pitches that are eliminated to some fixed number, for example omit 3 pitches out of every 4 pitches, 4 pitches out of every 5 pitches, and so on. This would provide a somewhat simpler implementation, but would not optimally use the storage media or communication channel. Adjusting the number of omitted pitches (or equivalently adjusting the frequency of the reference pitches) allows a predetermined level of speech quality or fidelity to be maintained automatically and without user intervention. If the communication channel is noisy for example, the correlation between adjacent pitches may tend to drop more quickly with each pitch, and a reference pitch will as result be transmitted more frequently to maintain quality. Similarly, the frequency of transmitted reference pitches will increase as necessary to adapt to the content of the speech or the manner in which the speech is delivered.

In yet another embodiment of the inventive structure and method, individual speaker vocabulary files are created to store the reference pitches and their identifiers for each speaker. The vocabulary file includes the speakers identity and the reference pitches, and is sent to the receiver along with the coded speech transmission. The vocabulary file is used to decode the transmitted speech. Optionally, but desirably, an inquiry may be made by the transmitting system as to whether a current vocabulary file for the particular speaker is present on the receiving system, and if a current vocabulary file is present, then transmission of the speech alone may be sufficient. The vocabulary file would normally be present if there had been prior transmissions of a particular speakers speech to the receiver.

Alternative Embodiments

In another embodiment, a plurality of vocabulary files may be prepared, where each of the several vocabulary file has a different number of classes of reference pitches and typically represents a different level of speech fidelity as a result of the number of reference pitches present. The sender (normally, but not necessarily the speaker) and the receiver may choose for example to receive a high-fidelity speech transmission, a medium-fidelity speech transmission, or a low-fidelity speech transmission, and the vocabulary file appropriate to that transmission will be provided. The receiver may also optionally set-up their system to receive all voice e-mail at some predetermined fidelity level, or alternatively identify a desired level of fidelity for particular speakers or senders. It might for example be desirable to receive voice e-mail from a family member at a high-fidelity level, but to reduce storage and/or bandwidth requirements for voice e-mail solicitations from salespersons to the minimum fidelity required to understand the spoken message.

In yet another embodiment of the inventive structure and method, noise suppression may be implemented with any of the above described procedures in order to improve the quality of speech for human reception and for improving the computer speech recognition performance, particularly in automated systems. Noise suppression may be particularly desirable when the speech is generated in a noisy environment, such as in an automobile, retail store, factory, or the like where extraneous noise may be present. Such noise suppression might also be desirable in an office environment owing to noise from shuffled papers, computer keyboards, and office equipment generally.

In this regard, it has been noted, that the waveforms of two temporally sequential speech pitches are extremely well correlated, in contrast to the typically completely uncorrelated nature of ordinary noise which is generally not correlated at the time interval of a single pitch duration (pitch duration is typically on the order of about 10 milliseconds). The correlation of adjacent speech pitches versus the uncorrelated noise that may be present in adjacent pitches provides an opportunity to optionally remove or suppress noise from the speech signal.

If we compare the waveforms of two neighboring pitches at all points in time they will be about identical at corresponding locations relative to the start point of each pitch, and will differ at points where noise is present. (Some variation in amplitude will also be present; however, this is expected to be small compared to problematic noise and is accounted for by the weighted reconstruction procedure already described.) Unfortunately, by looking at only two waveforms, we may not generally be able to determine (absent other information or knowledge) which waveform has been distorted by noise at a particular point and which waveform is noise-free (or has less noise) at that point, since noise may generally add either positive amount or a negative amount to the signal. Therefore, it is desirable to look at a third pitch to arbitrate the noise free from the noise contaminated signal value. As the noise in adjacent pitches is uncorrelated, it is highly unlikely that the third pitch will have the same noise as either the first or second pitch examined. The noise can then be removed from the signal by interpolating the signal amplitude values of the two pitches not having noise at that point to generate a noise free signal. Of course, this noise comparison and suppression procedure may be applied at all points along the speech signal according to some set of rules to remove all or substantially all of the uncorrelated noise. Desirably, noise is suppressed before the signals are compressed.

All publications, patents, and patent applications mentioned in this specification are herein incorporated by reference to the same extent as if each individual publication or patent application was specifically and individually indicated to be incorporated by reference. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

I claim:

1. A method for processing a speech signal comprising steps of:

identifying a plurality of portions of said speech signal representing individual speech pitches;

generating an encoded speech signal from a plurality of said speech pitches, said encoded speech signal retaining ones of said plurality of pitches and omitting other ones of said plurality of pitches, at least one speech pitch being omitted for each speech pitch retained; and generating a reconstructed speech signal by replacing each said omitted pitch with an interpolated replacement pitch having signal waveform characteristics which are interpolated from a first retained reference pitch occurring temporally earlier to said pitch to be interpolated and from a second retained reference pitch occurring temporally later than said pitch to be interpolated.

2. The method in claim 1, wherein said step of generating a reconstructed speech signal comprises the steps of:

interpolating said replacement pitches to have signal values that are linear interpolations of the signal amplitude values of the temporally earlier and temporally later pitches at corresponding times relative to the start of the pitches.

3. The method in claim 2, wherein the interpolated pitch signal amplitudes are interpolated according to the expression:

$$A^{i}_{pnew,t} = \left[A_{pref1,t} \times \frac{(n+1-i)}{(n+1)}\right] + \left[A_{pref2,t} \times \frac{(i)}{(n+1)}\right]$$

where $A^{i}_{pnew,t}$ is the computed desired amplitude of the new interpolated pitch for the sample corresponding to relative time t; $A_{pref1,t}$ is the reference pitch amplitude of the first reference pitch at the corresponding relative time t measured relative to the origin of each pitch; n is the number of pitches that have been omitted and which are to be reconstructed, and i is an index of the particular pitch for which the weighted amplitude is being computed.

4. The method in claim 1, wherein at least three out of four pitches are omitted and the reconstructed speech signal includes three pitches interpolated from the two surrounding reference pitches.

5. The method in claim 1, wherein at least four out of five pitches are omitted and the reconstructed speech signal includes four pitches interpolated from the two surrounding reference pitches.

6. The method in claim 1, wherein at least five out of six pitches are omitted and the reconstructed speech signal includes five pitches interpolated from the two surrounding reference pitches.

7. A speech processor for processing a speech signal, said speech processor comprising:

a plurality of delay circuits, each receiving said speech signal f(t) as an input and generating a different time delayed version of said speech signal $f(t-Td_i)$ as an output;

a plurality of correlator circuits, each said correlator circuit receiving said input speech signal f(t) and one of said time delayed speech signals $f(t-Td_i)$ and generating a correlation value indicating the amount of correlation between said speech signal f(t) and said time delayed speech signal;

a comparator circuit receiving said plurality of correlation values and generating an autocorrelation of said input signal with time delayed versions of said speech signal, one correlation value being received from each of said correlator circuits;

a pitch detector receiving said autocorrelation signal and identifying a pitch length for at least a portion of said speech signal; and an encoder receiving said pitch length and said speech signal and generating an encoded version of said speech signal wherein speech pitches of said speech signal are retained or omitted on the basis of said pitch detector input.

8. The speech processor in claim 7, further comprising:

a noise detector circuit receiving said comparator output signal and generating an output signal that is used when said pitch detector does not detect a pitch, said noise detector analyzing a non-correlated portion of said speech signal and determining the part of said speech signal that should be included as a representation in the encoded signal.

9. The speech processor in claim 7, further comprising:

a pitch counter circuit which compares the values of the auto-correlation function for a sequence of pitches and determines when the autocorrelation value crosses some predetermined threshold, a new reference pitch being inserted in said encoded signal when said value of said auto-correlation function drops below said threshold.

10. The speech processor in claim 9, wherein said auto-correlation threshold is set in the range between about 0.7 and 0.9.

11. The speech processor in claim 7, wherein said pitch detector comprises a vowel pitch detector and a consonant pitch detector;

said vowel pitch detector comprising means to receive said comparator output signal and calculating a vowel pitch length for high amplitude signals and large values of said autocorrelation function that are typical for vowel sounds;

said consonant pitch detector comprising means to receive said comparator output signal and calculating a consonant pitch length for low amplitude signals and small values of the autocorrelation function that are typical for consonant sounds.

12. The speech processor in claim 11, wherein said vowel pitch length is determined as the distance between two local maximums of the autocorrelation function which satisfy three conditions: (i) the vowel pitch length $L_v$ is between 50 and 200 msec, (ii) the adjusted pitches differ not more than about five percent (5%), and (iii) the local maximums of the autocorrelation function that marks the beginning and the end of each pitch are larger than any local maximums between them.

13. The speech processor in claim 11, wherein said consonant pitch length is determined as the distance between two local maximums of the autocorrelation function which satisfy three conditions: (i) the consonant pitch length $L_v$ is between 50 and 200 msec, (ii) the adjusted consonant pitches differ not more than about five percent (5%), (iii) the local maximums of the autocorrelation function that marks the beginning and the end of each consonant pitch are larger than any local maximums between them, and (iv) the consonant pitch length is close, within some predetermined length difference, to last pitch length determined by the consonant pitch detector or to the first pitch length determined by the vowel pitch detector after the consonant's pitch length is determined.

14. The speech processor in claim 7, further comprising:

a noise detector circuit receiving said comparator output signal and generating an output signal that is used when said pitch detector does not detect a pitch, said noise detector analyzing a non-correlated portion of said speech signal and determining the part of said speech signal that should be included as a representation in the encoded signal;

a pitch counter circuit which compares the values of the auto-correlation function for a sequence of pitches and determines when the autocorrelation value crosses some predetermined threshold, a new reference pitch being inserted in said encoded signal when said value of said auto-correlation function drops below said threshold; and said pitch detector comprises a vowel pitch detector and a consonant pitch detector;

said vowel pitch detector comprising means to receive said comparator output signal and calculating a vowel pitch length for high amplitude signals and large values of said autocorrelation function that are typical for vowel sounds;

said vowel pitch length is determined as the distance between two local maximums of the autocorrelation function which satisfy three conditions: (i) the vowel pitch length $L_v$ is between 50 and 200 msec, (ii) the adjusted pitches differ not more than about five percent, and (iii) the local maximums of the autocorrelation function that marks the beginning and the end of each pitch are larger than any local maximums between them;

said consonant pitch detector comprising means to receive said comparator output signal and calculating a consonant pitch length for low amplitude signals and small values of the autocorrelation function that are typical for consonant sounds;

said consonant pitch length is determined as the distance between two local maximums of the autocorrelation function which satisfy three conditions: (i) the consonant pitch length $L_v$ is between 50 and 200 msec, (ii) the adjusted consonant pitches differ not more than about five percent, (iii) the local maximums of the autocorrelation function that marks the beginning and the end of each consonant pitch are larger than any local maximums between them, and (iv) the consonant pitch length is close, within some predetermined length difference, to last pitch length determined by the consonant pitch detector or to the first pitch length determined by the vowel pitch detector after the consonant's pitch length is determined.

15. An electronic voice mail system for communicating an original speech signal message between a first computer and a second computer among a plurality of networked computers, said system said characterized in that:

said first computer system includes a first speech processor operative to generate a compressed encoded speech signal;

said second computer system includes a second speech processor operative to generate a decompressed reconstructed speech signal from said encoded signal;

said first speech processor comprising:

a plurality of delay circuits, each receiving said speech signal f(t) as an input and generating a different time delayed version of said speech signal $f(t-Td_i)$ as an output;

a plurality of correlator circuits, each said correlator circuit receiving said input speech signal f(t) and one of said time delayed speech signals $f(t-Td_i)$ and generating a correlation value indicating the amount of correlation between said speech signal f(t) and said time delayed speech signal;

a comparator circuit receiving said plurality of correlation values and generating an autocorrelation of said input signal with time delayed versions of said speech signal, one correlation value being received from each of said correlator circuits;

a pitch detector receiving said autocorrelation signal and identifying a pitch length for at least a portion of said speech signal; and an encoder receiving said pitch length and said speech signal and generating an encoded version of said speech signal wherein speech pitches of said speech signal are retained or omitted on the basis of said pitch detector input; and said second speech processor comprising:

a decoder receiving said encoded speech signal generated by said first speech processor, including receiving a plurality of reference pitches; and interpolation means for interpolating pitches occurring temporally between said reference pitches to generate a reconstructed version of said original speech signal.

16. A voice transmission system for communicating an original speech signal message over a low-bandwidth communications channel between a transmitting location and a receiving location, said system said characterized in that:

said transmitting location includes a first processor adapted to generate a compressed encoded speech signal;

said first processor comprising:

a signal delay processor receiving said original speech signal f(t) as an input and generating a plurality of different time delayed versions of said speech signal $f(t-Td_i)$ as outputs;

a signal correlator receiving said original speech signal f(t) and said time delayed speech signals $f(t-Td_i)$, i=1, . . . , n and generating correlation values indicating the amount of correlation between said speech signal f(t) and said time delayed speech signals;

a comparator receiving said correlation values and generating an autocorrelation result of said input signal with time delayed versions of said speech signal;

a pitch detector receiving said autocorrelation signal and identifying a pitch length for at least a portion of said speech signal; and an encoder receiving said pitch length and said original speech signal and generating an encoded version of said speech signal wherein speech pitches of said speech signal are retained or omitted on the basis of said pitch detector input.

17. The voice transmission system in claim 16, wherein said receiving location includes a second processor operative to generate a decompressed reconstructed speech signal from said encoded signal; and said second speech processor comprising:

a decoder receiving said encoded speech signal generated by said first processor, including receiving at least one reference pitch; and an interpolator for interpolating speech pitches occurring temporally adjacent said at least one reference pitch to generate a reconstructed version of said original speech signal.

18. The voice transmission system in claim 15, wherein said first processor comprises a hardware processor including a plurality of specialized speech processing circuits.

19. The voice transmission system in claim 15, wherein said first processor comprises a general purpose computer executing software or firmware to implement said signal delay processor, said signal correlator, said comparator, said pitch detector, and said encoder.

* * * * *